US005330369A

United States Patent [19]

Nozaki et al.

[11] Patent Number: 5,330,369

[45] Date of Patent: * Jul. 19, 1994

[54] CONNECTOR

[75] Inventors: Takao Nozaki; Masamitsu Chishima, both of Mie, Japan

[73] Assignee: Sumitomo Wiring Systems, Ltd., Mie, Japan

[ * ] Notice: The portion of the term of this patent subsequent to Apr. 20, 2010 has been disclaimed.

[21] Appl. No.: 36,234

[22] Filed: Mar. 24, 1993

Related U.S. Application Data

[62] Division of Ser. No. 684,403, Apr. 12, 1991, Pat. No. 5,217,390.

[30] Foreign Application Priority Data

| | | | |
|---|---|---|---|
| Apr. 16, 1990 | [JP] | Japan | 2-99578 |
| May 30, 1990 | [JP] | Japan | 2-57035[U] |
| Jun. 22, 1990 | [JP] | Japan | 2-66733[U] |
| Jul. 13, 1990 | [JP] | Japan | 2-74696[U] |

[51] Int. Cl.[5] ..... H01R 3/00

[52] U.S. Cl. ..... 439/489; 439/488; 439/350

[58] Field of Search ..... 439/350–358, 439/489, 488

[56] References Cited

U.S. PATENT DOCUMENTS

| | | | |
|---|---|---|---|
| 4,634,204 | 1/1987 | Detter et al. . | |
| 4,693,533 | 9/1987 | Szczesny et al. | 439/350 |
| 4,810,205 | 3/1989 | O'Grady | 439/350 |
| 4,946,404 | 8/1990 | Takenouchi et al. | 439/352 |
| 4,979,910 | 12/1990 | Revil et al. | 439/358 |
| 4,993,967 | 2/1991 | Matsumoto | 439/489 |

FOREIGN PATENT DOCUMENTS

| | | | |
|---|---|---|---|
| 87/07089 | 11/1987 | PCT Int'l Appl. . | |
| 2071928 | 9/1981 | United Kingdom | 439/358 |
| 2217927 | 1/1989 | United Kingdom . | |

*Primary Examiner*—Daniel W. Howell
*Assistant Examiner*—Hien D. Vu
*Attorney, Agent, or Firm*—Sughrue, Mion, Zinn, Macpeak & Seas

[57] ABSTRACT

A connector is constructed such that the front half portions of a pair of connector housings each accommodating a terminal are coupled with each other, and are locked and connected together by means of a pair of locking members. This connector comprises a detecting spacer locked and connected to one of the pair of connector housings by means of another pair of locking members and a lock-releasing portion provided on the other connector housing for releasing locking between the detecting spacer and the one of the pair of connector housings when the other connector housing is properly coupled with the one of the pair of connector housings.

1 Claim, 14 Drawing Sheets

CONNECTOR

This is a divisional of application Ser. No. 07/684,403 filed Apr. 12, 1991 now U.S. Pat. No. 5,217,390.

BACKGROUND OF THE INVENTION

1. Field of the Invention

The present invention relates to a connector in which a pair of connector housings are coupled and connected together so as to establish an electrical connection, and more particularly to a connector having a coupling detecting mechanism for detecting whether or not the pair of connector housings are properly coupled together, or a connector having a lock confirming mechanism for confirming the coupled posture of the pair of connector housings as well as the coupling detecting mechanism.

2. Statement of the Prior Art

The official gazette of Japanese Patent Public Disclosure (Kokai) No. 62-160674 (not examined) discloses a coupling detecting mechanism as a means for preventing the occurrence of partial coupling of a pair of connector housings in which the pair of connector housings are not properly coupled together because a distance by which the connector housings are actually being mated is too short. Namely, in a connector of this known type, a bar-like separate detecting spacer is mounted and locked on the upper side of one connector housing in a direction in which the one connector housing is coupled with the other connector housing, and this bar-like detecting spacer is then pushed forward after the two connector housings are coupled together to see whether the leading end of the detecting spacer "protrudes or not" from a detecting portion situated on the upper side of the connector in a coupled posture whereby whether the two connector housings are coupled properly or partially is visually judged.

In addition, there are many connectors having a coupled posture locking mechanism in which a resilient locking member provided on one of a pair of connector housings is mated with a locking pawl provided on the other connector housing for locking the two connector housings in a proper coupled posture.

With the above known connector having a coupling detecting mechanism, it is possible to effect a visual confirmation of the coupling condition of the connector by confirming the protrusion of the detecting spacer. However, the connector of this known type has the following drawbacks.

In a connector for a wire harness for an automobile, there are many eases in which connector housings are connected together in a limited space, and in a particular ease, connector housings have to be connected together by feel, in which case the visual confirmation described above is not possible. In order to make it possible to effect a proper visual confirmation of the status of the detecting spacer, the connecting posture of the connector has to be limited such that the leading end of the detecting spacer is easily seen.

In the case of a connector in which the associate connector housing is mounted for an apparatus, it is not possible to provide a detecting portion for detecting the leading end of the detecting spacer on the associate connector housing, and therefore it is not possible to adopt this coupling detecting mechanism.

In the coupled posture locking mechanism described above, whether or not the locking mechanism is properly working is confirmed through the feel of a locking operation or in a visual fashion, resulting in poor confirmation reliability, which sometimes causes a defective connector in which locking is not properly effected.

SUMMARY OF THE INVENTION

An object of the present invention is to obtain a connector in which proper coupling of a pair of connector housings is securely detected.

Another object of the present invention is to obtain a detecting spacer capable of being taken out only when a pair of connector housings are properly coupled together.

With a view to accomplishing the above objects, the present invention provides a connector in which the front half portions of a pair of connector housings each accommodating a terminal are mated with each other and locked together by means of a pair of locking members, the connector comprising a detecting spacer that is locked and connected to one of the pair of connector housings by means of another pair of locking members, and a lock-releasing portion provided on the other connector housing for releasing the lock between the detecting spacer and the one of the pair of connector housings when the two connector housings are properly coupled together.

An optimum embodiment of a connector according to the present invention is characterized in that a separate detecting spacer having a cantilever-like resilient locking member extending from the base portion thereof is inserted into one of connector housings in the coupling direction thereof so as to be secured thereto with the base portion being caused to protrude rearwardly of the connector housing, that a withdrawal locking means for preventing the withdrawal of the detecting spacer is also provided on the one of connector housings, and that a lock-releasing portion for the withdrawal locking means is provided on the other connector housing which confronts the leading end of the resilient locking member and is brought into engagement with the leading end of the resilient locking member when the pair of connector housings are put in a proper coupled posture.

In the connector of the present invention, when the pair of connector housings are put in a proper coupled posture, the detecting spacer inserted into and locked on the one of connector housings with the rear end thereof protruding from the same connector housing is released from a locked condition by means of the lock-releasing portion on the other connector housing so as to be freely withdrawn, whereby the proper coupling of the two connector housings is judged through the withdrawal and absence of the detecting spacer, as well as the administration of the number of the detecting spacers, while in the case of partial coupling of the connector housings caused when a distance by which the connector housings are actually being mated is too short, the withdrawal of the detecting spacer continues to be prevented, which does not permit the detecting spacer to be pulled out. Thus, proper or unproper coupling of the connector housings can accurately be confirmed by visually or feelingly confirming the existence/absence of the detecting spacer, as well as through the administration of the number of the detecting spacers.

In a case where the connector is constructed such that the front half portions of a pair of connector housings each accommodating a terminal are mated with each other and has a coupled posture locking mechanism comprising a locking member in the form of a resilient beam provided on one of the connector housings and a locking pawl provided on the other connector housing, wherein the locking member and locking pawl are mated together for engagement when the locking member is restored to its free posture after the leading end of the locking member is flexed downwardly by means of the locking pawl, a separate detecting spacer in which a cantilever-like resilient locking member for preventing the withdrawal of the detecting spacer by allowing a first locking pawl provided on the underside of the leading end thereof to be brought into engagement with the locking portion on the connector housing side and a downward flexing detecting member having a second locking pawl provided on the top side of the leading end thereof so as to allow the downwardly flexed leading end of the locking member to be brought into engagement with the rear locking wall therfor are provided in parallel is inserted into one of the pair of connector housings in the coupling direction thereof so as to be secured thereto with the rear end therfor protruding rearwardly of the connector housing, and a tongue-like lock-releasing portion that confronts the leading end of the resilient locking member and is brought into engagement with the leading end of the resilient locking member when the pair of connector housings are put in a proper coupled posture is provided on the other connector housing, whereby it is possible to provide a coupling detecting mechanism and a lock confirming mechanism for a coupled posture comprising the detecting spacer and the lock-releasing portion, respectively.

In this connector, when the pair of connector housings are put in a proper coupled posture, the detecting spacer inserted into and locked on the one of connector housings with the rear end thereof protruding form the same connector housing is released form a locked condition by means of the lock-releasing portion on the other connector housing so as to be freely withdrawn, whereby the proper coupling of the two connector housings is judged through the withdrawal and absence of the detecting spacer, as well as the administration of the number of the detecting spacers. In the case of partial coupling of the connector housings caused when a distance by which the connector housings are actually being mated is too short, the first locking pawl of the detecting spacer continues to be locked, which does not permit the detecting spacer to be pulled out. Thus, proper or unproper coupling of the connector housings can accurately be confirmed by visually or feelingly confirming the existence/absence of the detecting spacer, as well as through the administration of the number of the detecting spacers.

In addition, when the locking member and locking pawl of the pair of connector housings are mated and locked properly, since the locking member is then restored to its free posture, there is no interference between the second locking pawl of the downward flexing detecting member of the detecting spacer and the locking member, thereby allowing the detecting spacer to be freely pulled out. In contrast, when the locking member is kept flexed downwardly due to the unproper locking of the locking member and locking pawl, the locking member interferes with the second pawl of the downward flexing detecting member, thereby prohibiting the detecting spacer from being pulled out. Thus, whether or not the locking mechanism properly works is accurately confirmed by visually or feelingly confirming the existence/absence of the detecting spacer, as well as through the administration of the number of the detecting spacers.

Moreover, since whether or not the detecting spacer can be pulled out is restricted by means of the first and second locking pawls, there are two main functioning points in the coupled posture detecting mechanism, which remarkably improves the detecting reliability.

Furthermore, a separate detecting spacer having a front dead point locking member in the form of a cantilever-like resilient locking member for preventing the withdrawal of the detecting spacer by allowing a first locking pawl provided on the underside of the leading end thereof to be brought into engagement with the front dead point locking portion on the connector housing side, a downward flexing detecting member having a second locking pawl provided on the top side of the leading end thereof so as to allow the downwardly flexed leading end of the locking member to be brought into engagement with the rear locking wall therfor, and a third locking pawl brought into engagement with the rear dead point locking portion on the connector housing, designed to move back and forth between the from and rear dead points, and comprising a detecting portion and a knob portion which are integrally formed, the former being exposed only when the detecting spacer is situated at the rear dead point, the latter protruding from the connector housing when the same spacer at the front dead point is inserted into one of the pair of connector housings, and a tongue-like lock-releasing portion that confronts the leading end of the front dead point locking member and is brought into engagement with the leading end of the front dead point locking member when the pair of connector housings are put in a proper coupled posture is provided on the other connector housing, whereby it is possible to provide a coupling detecting mechanism and a lock confirming mechanism for a coupled posture comprising the detecting spacer and the lock-releasing portion, respectively.

In this connector, in the case of partial coupling of the connector housings caused when a distance by which the connector housings are actually being mated is too short, since the engagement between the front dead point locking portion and the first locking pawl is maintained, the detecting spacer is prevented from being withdrawn, and this in turn prevents the detection porting portion from being exposed, thereby making it possible to detect a coupling error.

In a case where the connector is constructed such that the front half portions of a pair of connector housings each accommodating a terminal are mated with each other and has a coupled posture locking mechanism in which the leading end of a cantilever-like resilient locking member on one of a pair of connector housings first interferes with the locking portion of the other connector housing so as to be flexed downwardly, and is then restored to its upper position so as to be brought into engagement with the locking portion after a lapse of predetermined time, the detecting spacer is temporarily mounted and locked below the locking portion of the other connector housing in the direction normal to the above coupling direction in such a manner as to be freely pulled out with one end thereof protruding from the side wall of the connector housing. The intermidate portion of the detecting spacer is formed into a downward flexing recessed portion for the resilient locking member, and at least the side of the downward flexing recessed portion which is on the side opposite to the above protruding side is formed into a raised portion which interferes with the resilient locking member when the locking member is in a downward posture, and allows the resilient locking member to pass therethrough when the locking member is in a free posture.

In other words, the above detecting spacer constitutes a coupling confirming mechanism for a pair of connector housings, and when there is an engagement error in the locking mechanism due to the partial coupling of the pair of connector housings, the leading end of the resilient locking member on one side that is downwardly flexed due to the interference with the locking portion interferes with the interference raised portion of the detecting spacer, thereby prohibiting the detecting spacer from being pulled out. In contrast, when the pair of connector housings are properly coupled together with the locking mechanism being in a proper engagement, the detecting spacer can be pulled out.

DETAILED DESCRIPTION OF THE PREFERRED EMBODIMENTS

Figure 1:
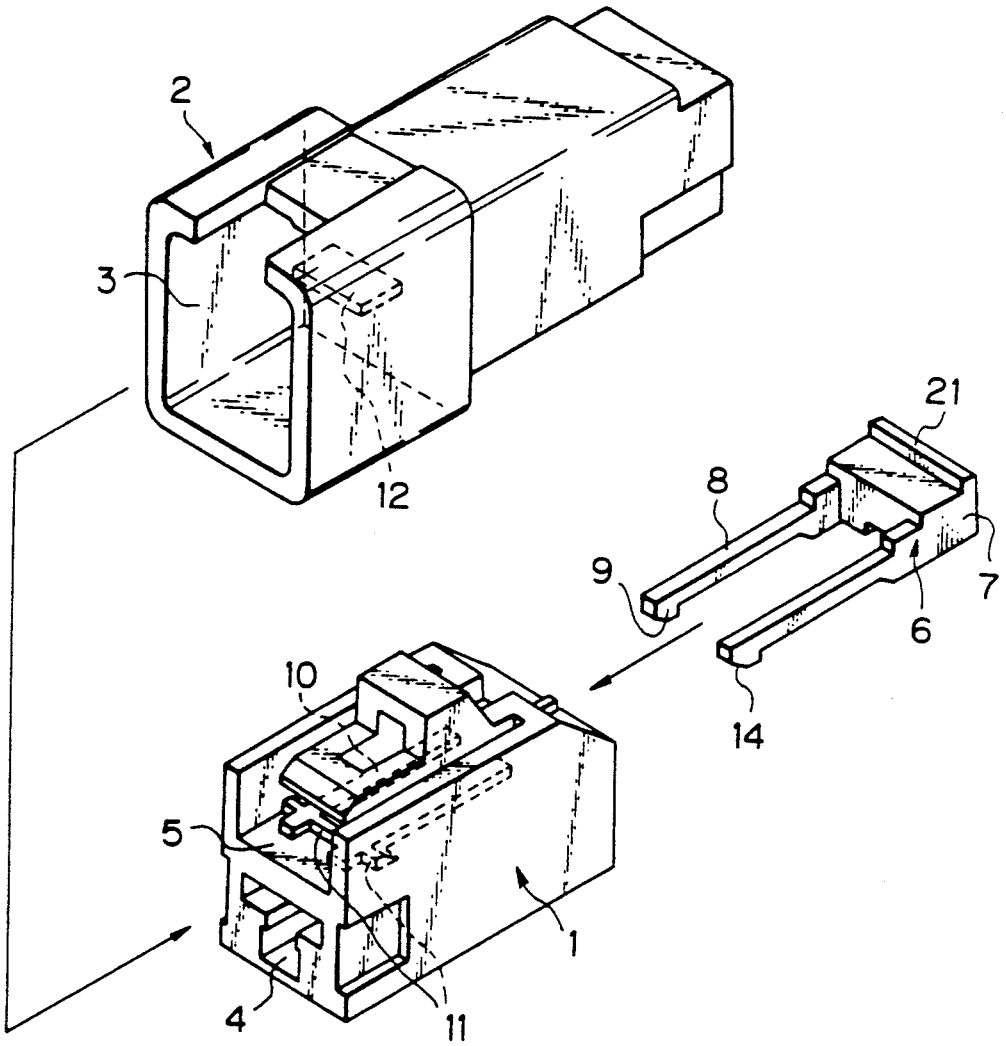
FIG. 1 is an exploded perspective view of a first embodiment of a connector according to the present invention.
Figure 2:
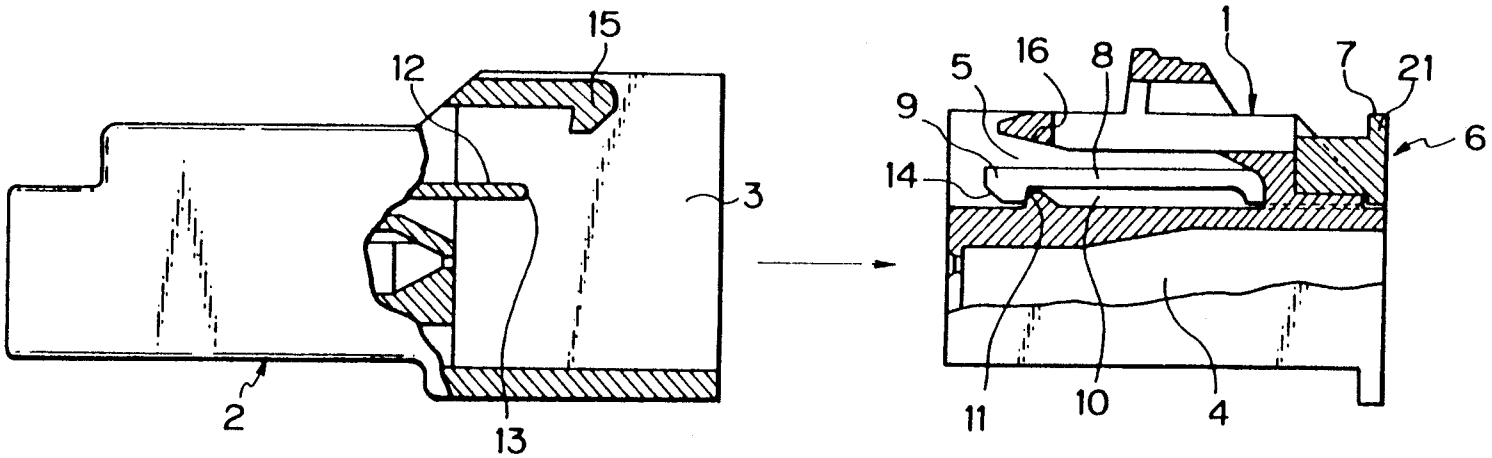
FIG. 2 is a partially cutaway side view showing a state in which the connection of FIG. 1 is separated.

Referring to FIGS. 1 to 3, a first embodiment of a connector according to the present invention will be described. As shown in FIGS. 1 and 2, in a connector in which the front half portion of the mating portion 3 of a male connector housing 2 (hereinafter, simply referred to as a male housing 2) accommodating a male terminal (not shown) is mated with the front half portion of a female connector housing 1 (hereinafter, simply referred to as a female housing 1) accommodating a female terminal (not shown) for connection of the terminals accommodated in the both housings, a spacer accommodating portion 5 is provided above a terminal accommodating portion 4 of the female housing 1, and a separate detecting spacer 6 is inserted thereinto from the rear of the spacer accommodating portion 5 as to be locked thereat with the leading end of the detecting spacer 6 facing forward.

To be specific, as shown in FIG. 1, the detecting spacer 6 is provided with two parallel cantilever-like resilient locking members 8 extending forward from a base portion 7, and a locking pawl 9 downwardly projecting is formed on the underside of the free end of each resilient locking member 8. The spacer accommodating portion 5 for receiving therein this detecting spacer 6 is formed in the upper portion of the female housing 1 so as to be a channel longitudinally extending therethrough, and elongate guide projections 10 each having a locking portion 11 at the front end thereof are formed on the bottom of the spacer accommodating portion 5 in such a manner as to project therefrom. As shown in FIG. 2, when the detecting spacer 6 is inserted into the spacer accommodating portion 5 from the rear of the female housing 1 so as to be secured thereto, the locking pawls 9 of the resilient locking members 8 which are in a free state are brought into mesh engagement with the locking portions 11 of the elongate guide projections 10, whereby the detecting spacer 6 is locked in place in such a manner as not to be withdrawn.

The locking pawls 9 when in a locking posture confront a lock-releasing portion 12 (to be described later) of the male housing 2 into which the locking pawls 9 are fitted, and a "knob portion" 21 formed on the base portion 7 is used when the detecting spacer is withdrawn.

Figure 3A:
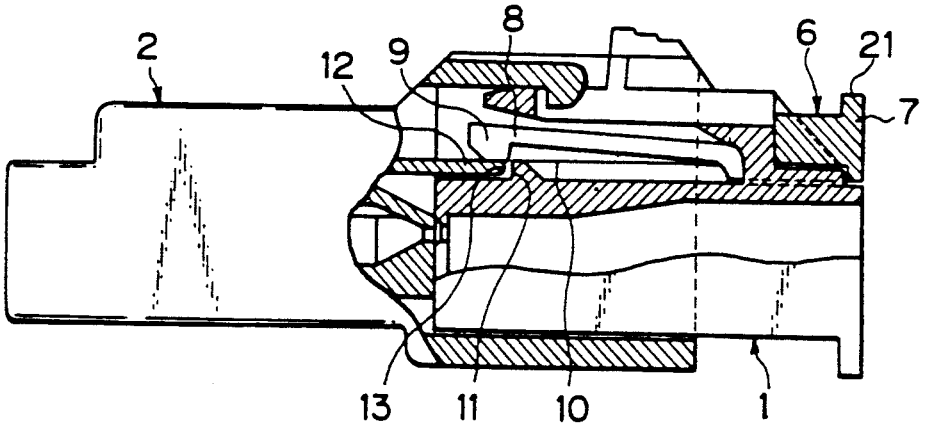
FIGS. 3(A), 3(B), and 3(C) are partially cutaway side views showing several types of coupling states of the connector of FIG. 1 respectively.

The tongue-like lock-releasing portion 12 protruding forward is provided on the rear bottom portion of the mating portion 3 of the male housing 2 in order to release a withdrawal locking means so as not only to free the detecting spacer 6 when the female and male housings 1, 2 are properly coupled together but also to function as a rib for preventing twisting of the housing. As shown in FIG. 3(A), this lock-releasing portion 12 has relative position and configuration such that when the female and male housings 1, 2 are in a proper coupled posture, the leading end 13 of the lock-release portion 12 comes closer to and confronts the locking portions 11 on the male housing 2 side so as to forcibly move upward the locking pawls 9 of the resilient locking members 8 which are in mesh with the locking portions 11 thereby to resiliently flex the resilient locking members 8 upward, the engagement between the two members being thus released.

In order to effect the forcible moving up of the locking pawls 9 by means of the lock-releasing portion 12 in a smooth fashion, a guide taper 14 is imparted to the front end of the locking pawls 9.

In addition, a locking mechanism is provide in the female and male housings 1, 2 which comprises a locking pawl 15 on the male housing 2 side and a locking member 16 on the female housing 1 side, and when the female and male housings are properly coupled together, these locking pawl 15 and locking member 16 are brought into engagement with each other, whereby the connector housings are locked in a coupled posture.

Figure 3B:
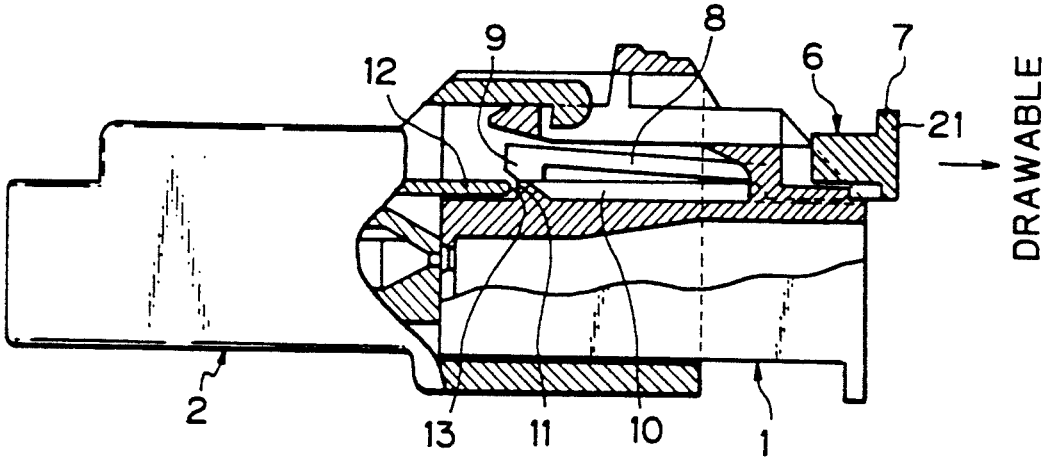

In the above-described connector having the detecting spacer 6, when the respective housings are coupled in a proper posture, the front end of the lock-releasing portion 12 on the male housing 1 side comes closer to and confronts the locking portion 11 on the female housing 2 side, and the locking member 8 of the detecting spacer 6 that is locked at the locking portion 11 is then forcibly moved up, which releases the detecting spacer 6 from the locked state, thereby making it possible to freely withdraw the detecting spacer 6. As shown in FIG. 3(B), the detecting spacer 6 is pulled out after the housings are coupled in a proper posture, and the connector without the detecting spacer 6 is judged as being a properly coupled connector, and it is possible to grasp the overall coupling conditions through the administration of the number of detecting spacers.

Figure 3C:
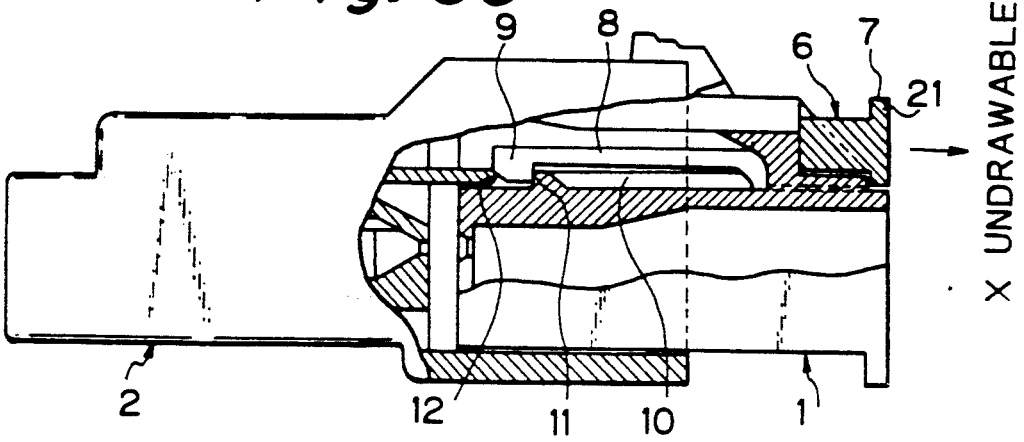

In the case of partial coupling in which a distance by which the female and male housings 1, 2 are coupled together is too short, as shown in FIG. 3(C), the distance in which the lock-releasing portion 12 moves forward is too short, and the front end 13 cannot move upward the locking pawl 9 of the detecting spacer 6 which is in a locked state to a sufficient extent, which allows the detecting spacer 6 to remain in a locked state, thereby prohibiting the detecting spacer 6 from being withdrawn. Thus, the connector with the detecting spacer 6 is judged as being a defective connector in which the coupling distance is not sufficient.

The embodiment of the connector as described above has the above-mentioned function in which whether the coupled posture of the connector is proper or unproper can be judged by visually or feelingly confirming the existence/absence of the detecting spacer 6, as well as effectiveness in which the overall coupling conditions can be checked through the administration of the number of detecting spacers withdrawn. For instance, painting the detecting spacer 6 "red" or the like which is easy to recognize facilitates the judgement of the existence/absence of the detecting spacer. In addition, since it is possible to freelingly confirm the existence/absence of the detecting spacer, the connector of the present invention is extremely suitable for use for a wire harness for an automobile in which connector housings are connected together by feel, or in which visual grasping of the connector conditions is difficult, and when used for such a purpose, it is possible to prevent the occurrence of coupling errors in advance, and since there is no limitation to the direction in which a connector is mounted, and moreover since the insertion and withdrawal of the detecting spacer 6 can be limited to one of the connector housings, the connector of the present invention can be used as a coupling detecting mechanism even for a connector for an apparatus in which the other connector housing is secured to the apparatus. In addition, in a case where the connector is used at a position where coupling detection is not necessary, it is possible to use the connector without the detecting spacer as a normal connector.

In the structure of the present invention described above, the number of the resilient locking members 8 of the detecting spacer 6 may be one, not two, or it may be formed into a plate-like member. In addition, the withdrawal locking means and the lock-releasing portion for the detecting spacer 6 may be formed into other shapes, or may be replaced with known means provided that those shapes and known means meet the technical requirement.

Referring to FIGS. 4 to 8, a second embodiment of the connector according to the present invention will be described.

Figure 4:
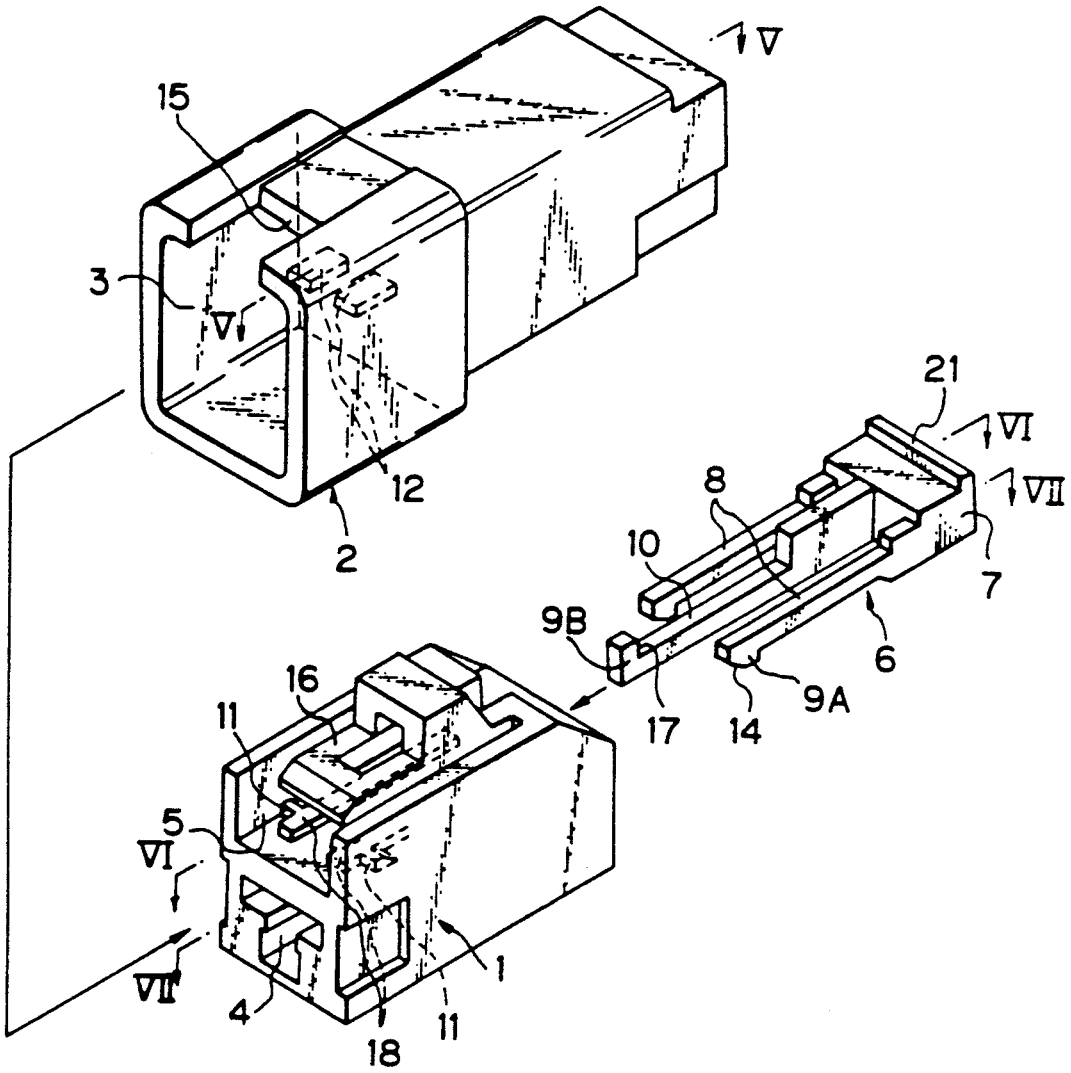
FIG. 4 is an exploded perspective view of a second embodiment of the connector according to the present invention.

As shown in FIG. 4, the detecting spacer 6 is provided with two parallel cantilever-like resilient locking members 8 extending forward from the base portion 7, and a first locking pawl 9A is formed on the underside of the free end of the respective resilient members 8 in such a manner as to downwardly project therefrom. On top of this, a cantilever-like downward flexing detecting member 10 extending forward from the base portion 7 in parallel with the pair of resilient locking members 8 and having a second locking pawl 9B projecting from the upper side of the free end thereof is provided centrally between the pair of resilient locking members 8.

Figure 5:
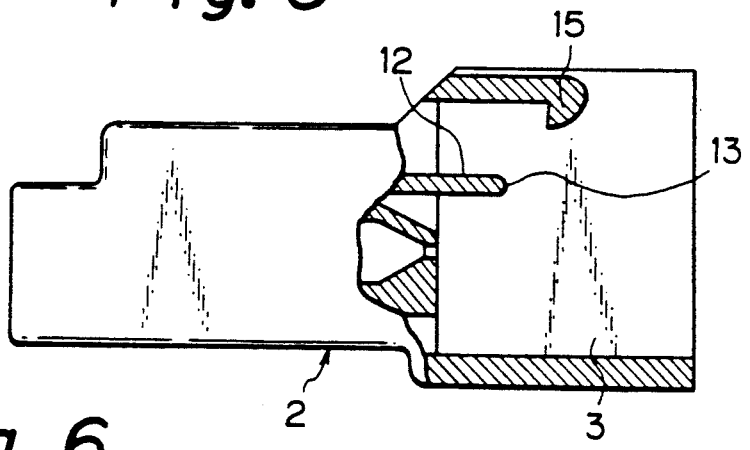
FIG. 5 is a partially cutaway side view taken from the line V—V of FIG. 4.
Figure 6:
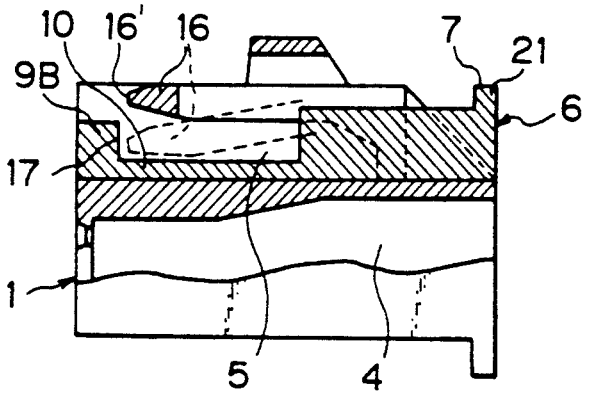
FIG. 6 is a partially cutaway side view taken from the line VI—VI of FIG. 4.
Figure 7:
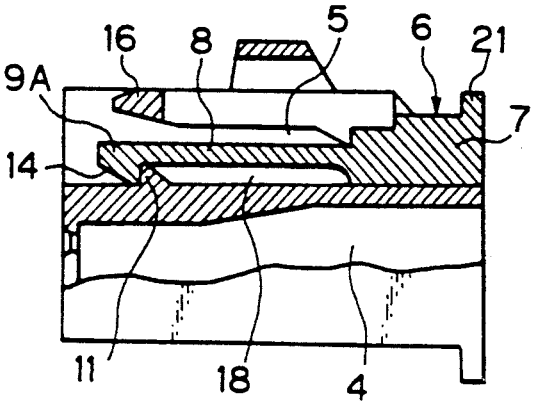
FIG. 7 is a partially cutaway side view taken from the line VII—VII of FIG. 4.

As shown in FIGS. 5 to 7, the spacer accommodating portion 5 for receiving the detecting spacer 6 is formed in the upper portion of the female housing 1 in such a manner as to longitudinally extend therethrough, and elongate guide projections 18 each having a locking portion 11 at the front end therof are provided on both sides of the bottom portion of the spacer accommodating portion 5 in a longitudinal direction. When the detecting spacer 6 is inserted into the spacer accommodating portion 5 from the rear of the female housing 1 so as to be secured thereto, the first locking pawls 9A of the resilient locking members 8 which are in a free state are then brought into mesh engagement with the locking portions 11 on the leading end of the respective elongate guide projections 18, whereby the detecting spacer 6 is locked so as not to be withdrawn.

The first locking pawls 9A when in a locking posture confront the lock-releasing portion 12 (to be described later) of the male housing 2 into which the locking pawls 9 are fitted, and a "knob portion" 21 formed on the base portion 7 is used when the detecting spacer is withdrawn.

Furthermore, as shown in FIG. 6, the downward flexing detecting member 10 extends in parallel with the locking member 16 (to be described later) of the female housing 1 thereunder, and the second locking pawl 9B projecting from the upper side of the leading end of the downward flexing detecting member 10 extends forward beyond the leading end of the locking member 16 such that a rear wall 17 of the second locking pawl 9B is situated forward beyond the leading end 16' of the locking member 16. When the locking member 16 is downwardly flexed so as to allow the female and male housings 1, 2 to be coupled together, the leading end 16' of the locking member 16 which is in a downward flexing posture is then situated rearwardly of the locking wall 17 of the second locking pawl 9B as indicated by the dotted line in FIG. 6, whereby the withdrawal of the detecting spacer 6 is prevented. Thus, the downward flexing detecting portion 10 has a configration meeting configurational requirements for the prevention of withdrawal of the detecting spacer 6.

Figure 8A:
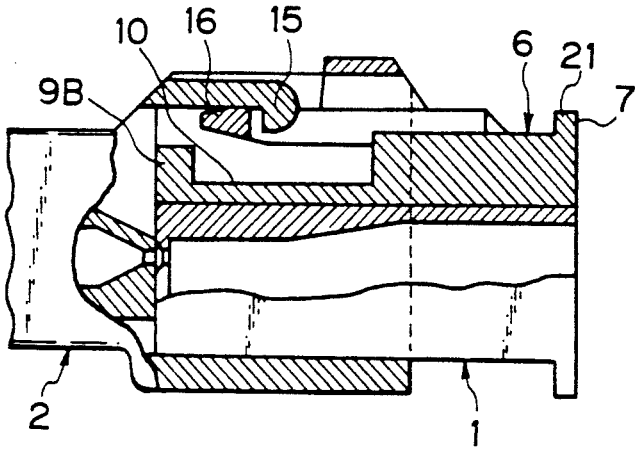
FIGS. 8 (A), (B), (C), and (D) are partially cutaway side views showing several types of coupling states of the connector of FIG. 1 respectively.
Figure 8B:
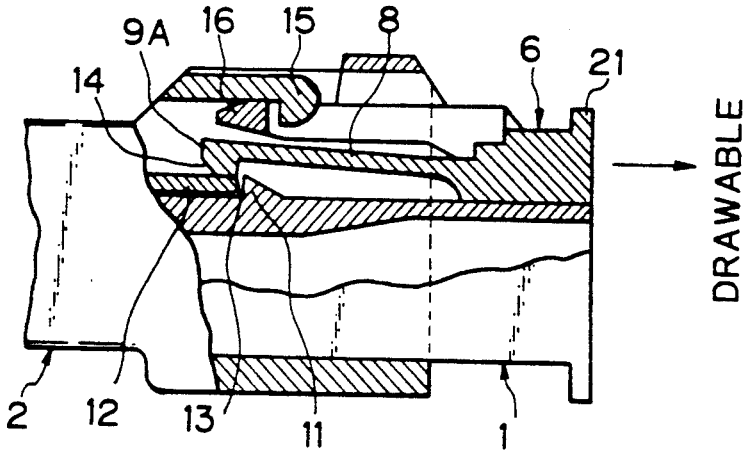

The tongue-like lock-releasing portion 12 (FIG. 5) protruding forward is provided on the rear bottom portion of the mating portion 3 of the male housing 2 in order to release a withdrawal locking means so as not only to make the detecting spacer 6 free when the female and male housing 1, 2 are properly coupled together but also to function as a rib for preventing twisting of the housing. As shown in FIG. 8(B), this lock-releasing portion 12 has relative position and configuration such that when the female and male housings 1, 2 are in a proper coupled posture, the leading end 13 of the lock-releasing portion 12 comes nearer to and confronts the locking portion 11 on the male housing 2 side so as to forcibly move upward the first locking pawls 9A of the resilient locking members 8 which are in mesh with the locking portion 11 thereby to resiliently flex the resilient locking members 8 upward, the engagement between the resilient locking members 8 and locking portions 11 being thus released.

In order to effect the forcible moving up of the first locking pawl 9A by means of the lock-releasing portion 12 in a smooth fashion, a guide taper 14 is imparted to the front end of the first locking pawl 9A.

In addition, a locking mechanism is provided in the female and male housings 1, 2 which comprises a locking pawl 15 on the male housing 2 side and a resilient cantilever-like locking member 16 on the female housing 1 side, and when the female and male housings 1, 2 are properly coupled together, the locking pawl 15 downwardly flexes the leading end of the locking member 16, and when the housings are finally coupled, the downwardly flexing of the locking member 16 is released, and the locking member 16 is restored to its free state, whereupon the locking pawl 15 and locking member 16 are brought into mesh engagement with each other, the housings being thereby locked in the coupled posture.

Thus, the detecting spacer 6 and the lock-releasing portion 12 constitute the coupled posture detecting mechanism and the lock confirming mechanism for a coupled posture for the female and male housings 1, 2, respectively.

In the connector described above, when the housings are properly coupled together with the locking member 16 and the locking pawl 15 being put in a proper locked posture, as shown in FIG. 8(B), the leading end 13 of the lock-releasing portion 12 of the male housing 2 forcibly moves upward the first locking pawl 9A which is locked at the locking portion 11 so as to release the first locking pawl 9A from the locked state, and since the locking member 16 in a proper locked position is then restored to its free posture, there is no interference between the locking member 16 and the second locking pawl 9B, which allows the detecting spacer 6 to be freely withdrawn. Thus, the connector which is properly coupled together without the detecting spacer 6 is judged as being a properly locked connector.

Figure 8C:
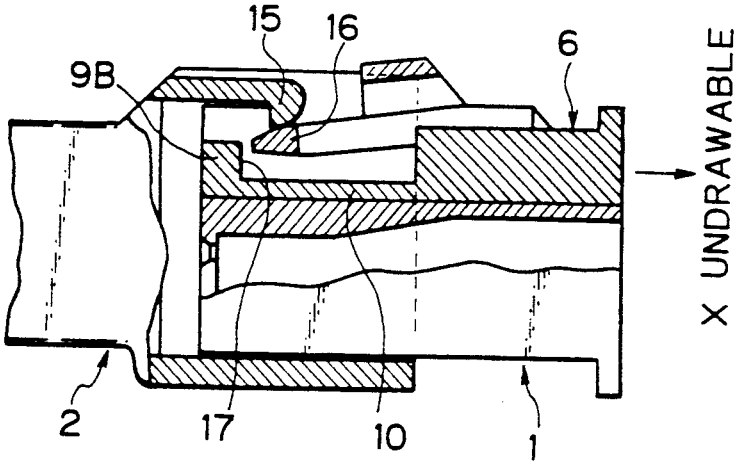
Figure 8D:
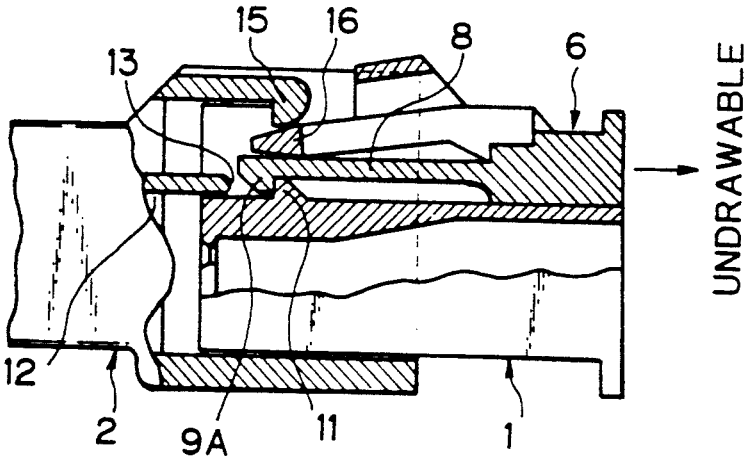

In the case of partial coupling in which the female and male housings 1, 2 are not completely coupled to one another, as shown in FIG. 8(C), 8(D), the distance in which the lock-releasing portion 12 moves forward is not sufficient so that the front end 13 cannot move the first locking pawl 9A of the detecting spacer 6, which is in a locked state, upwardly to a sufficient extent, which allows the detecting spacer 6 to remain in a locked state with the locking member 16 in a downward flexing posture interfering with the locking wall 17 of the second locking pawl 9B, thereby prohibiting the detecting spacer 6 from being withdrawn. Thus, the connector with the detecting spacer 6 is judged as being a defective connector having coupling or locking errors.

Moreover, since this connector has a double locking mechanism for the "restriction of withdrawal of the detecting spacer 6" by means of the first and second locking pawls 9A, 9B, high reliability can be obtained.

Thus, with the connector of the above embodiment, it is possible to prevent in advance connecting and locking errors of a connector.

Figure 9:
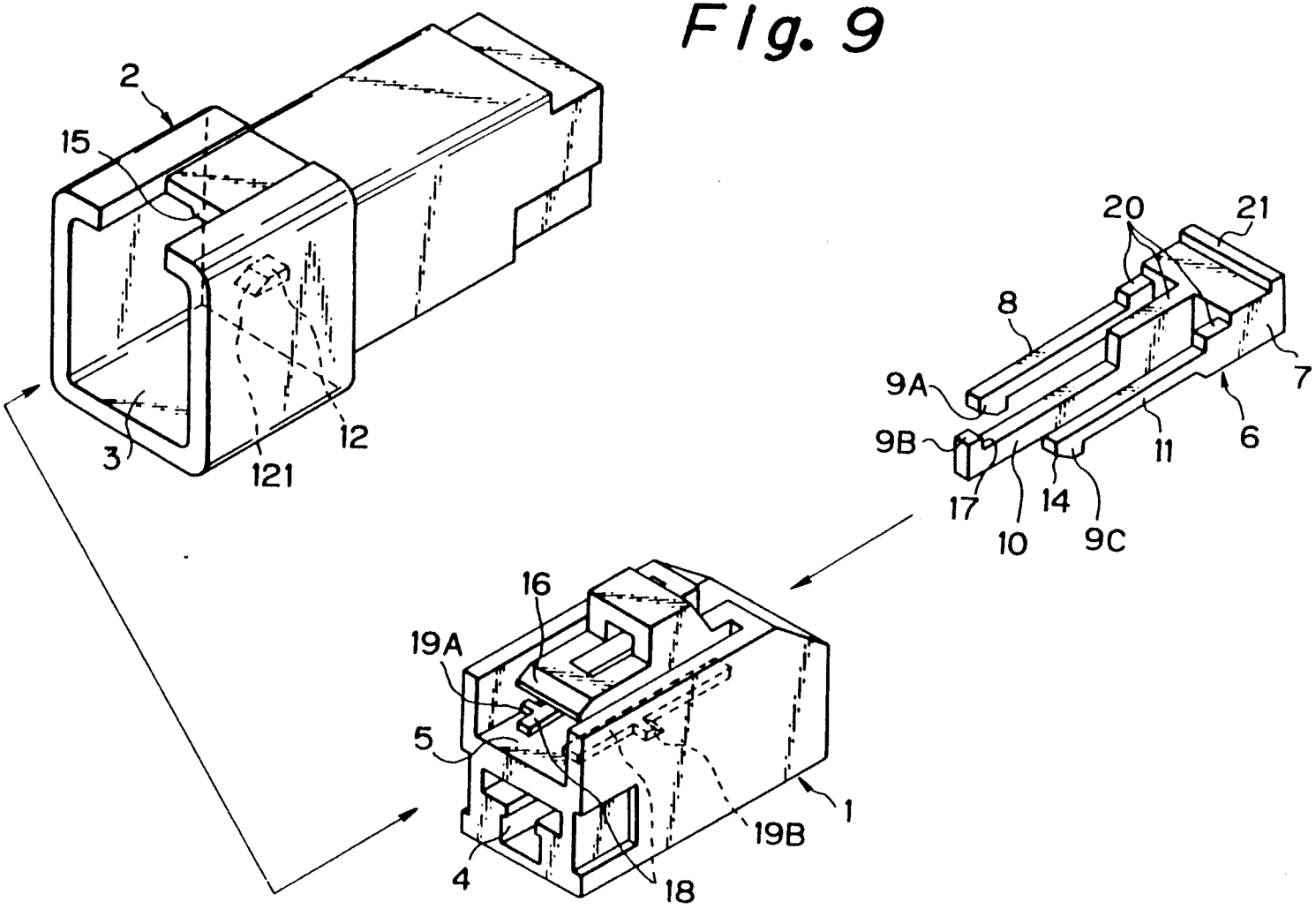
FIG. 9 is an exploded perspective view of a third embodiment of the connector according to the present invention.

Referring to FIGS. 9 to 11, a third embodiment of the connector according to the present invention will be described.

As shown in FIG. 9, the detecting spacer 6 is provided with a front dead point locking member 8, a downward flexing detecting member 10, and a rear dead point locking member 11 which are all extending from the base portion 7 in a cantilever-like fashion. The front dead point locking member 8 on one side is formed into a resilient beam and has a first locking pawl 9A projecting from the underside of the leading end therof. A second locking pawl 9B is formed on the upper side of the leading end of the centrally disposed downward flexing detecting member 10, and a third locking pawl 9C is formed on the underside of the leading end of the rear dead point locking member 11 in such a manner as to project downwardly therefrom.

Figure 10A:
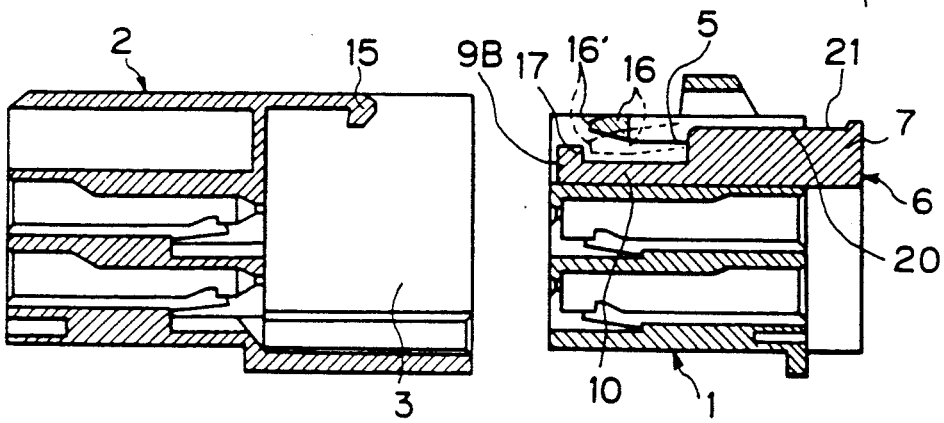
FIGS. 10 (A), (B) and C) are longtudinal sectional views showing states in which the connector of FIG. 9 is separated, respectively.
Figure 10B:
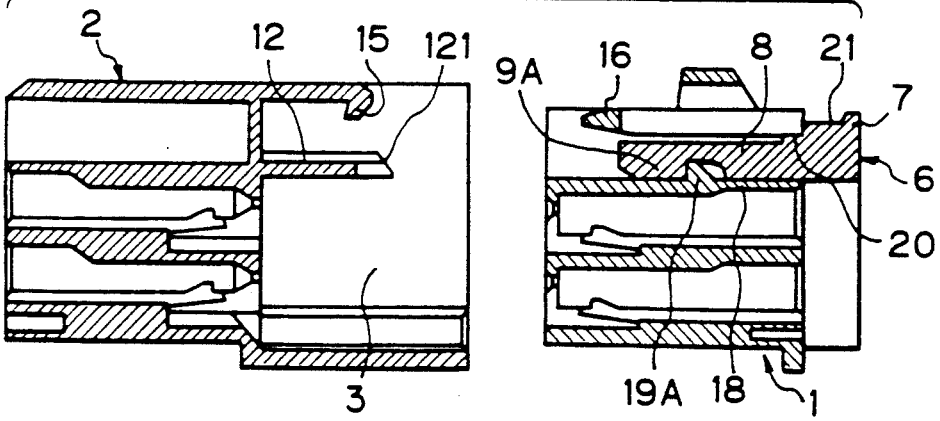

The spacer accommodating portion 5 for receiving this detecting spacer 6 is formed in the upper portion of the female housing 1 in such a manner as to longitudinally extend therethrough, and elongate guide projections 18 having a forward front dead point locking portion 19A and an intermediate rear dead point locking portion 19B are formed on the bottom of the spacer accommodating portion 5. When the detecting spacer 6 is inserted into the spacer accommodating portion 5 from the rear therefrom so as to be secured thereto, as shown in FIGS. 10(A), and 10(B), the first locking pawl 9A at the front dead point position is brought into mesh engagement with the front dead point locking portion 19A, whereby the detecting spacer 6 is locked so as not to be withdrawn. When the detecting spacer 6 is released from this locked position and is allowed to withdraw by a predetermined stroke L, as shown in FIG. 11(C), the third locking pawl 9C of the rear dead point locking member 11 is brought into mesh engagement with the rear dead point locking portion 19B. whereby the detecting spacer 6 is locked so as not to be withdrawn further, the detecting spacer 6 being thus allowed to move back and forth by the stroke L in which the front and rear dead point positions are restricted.

Figure 10C:
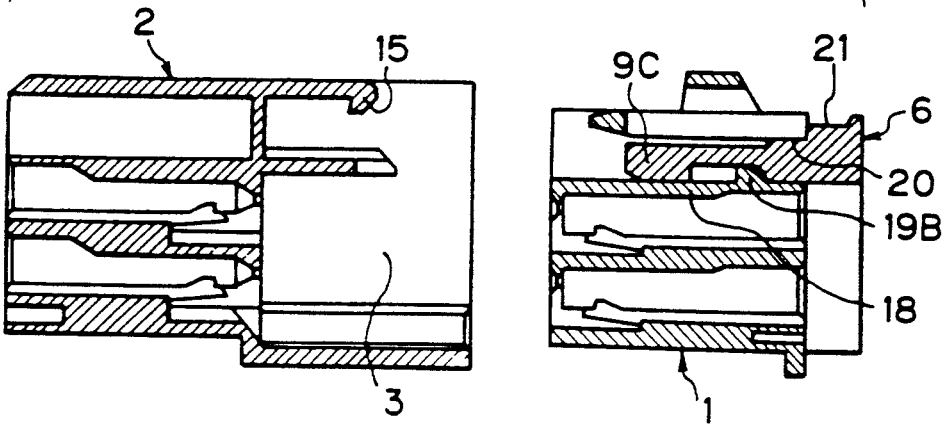

The third locking pawl 9C of the read dead point locking member 11 at the front dead point position in FIG. 10(B) is situated forwardly of the rear dead point locking portion 19B as shown in FIG. 10(C).

Figure 11A:
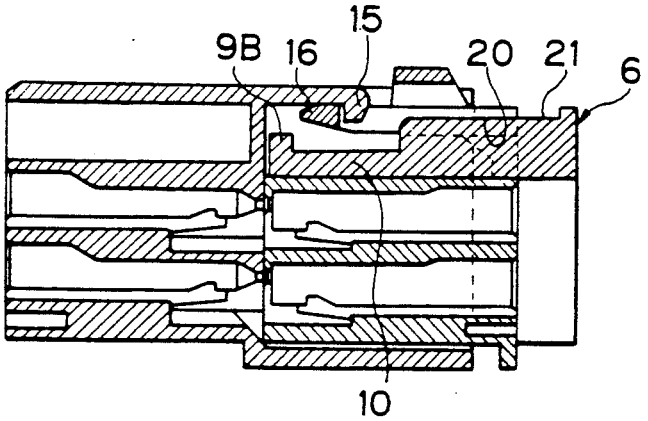
FIGS. 11 (A), (B), (C), (D), and (E) are partially cutaway views showing several types of coupling states of the connector of FIG. 9.
Figure 11B:
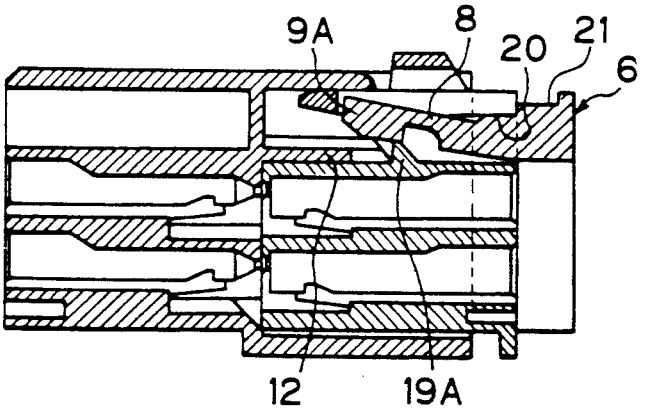
Figure 11C:
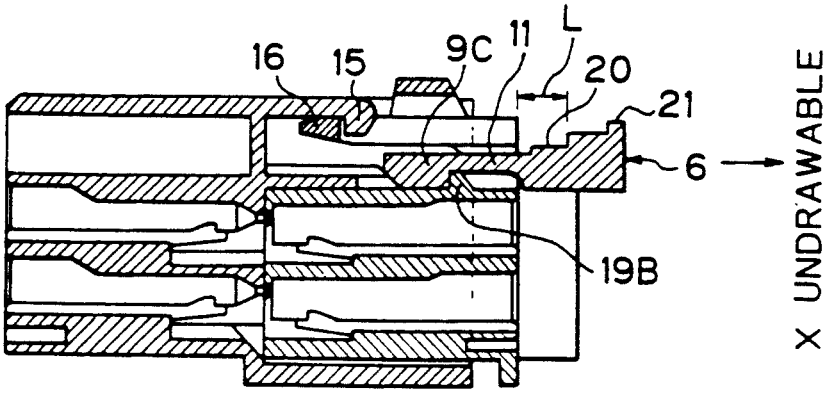

The base portion 7 of the detecting spacer 6 is formed into a knob portion 21 becoming exposed from the housing when the detecting spacer 6 is at the front dead point position in FIGS. 9, 10(A), and 10(B) so as to function as a knob member for pushing and/or pulling of the detecting spacer 6, and the upper side of the base portion 7 extending beyond the knob portion 21 is formed into a detecting portion 20 which becomes exposed form the housing when the detecting spacer 6 is at the rear dead point position in FIG. 11(C) and becomes hiden inside the housing when the detecting spacer 6 is at the front dead point position, the length of the detecting portion 20 being substantially equal to the stroke L.

Furthermore, as shown in FIG. 10(A), the downward flexing detecting member 10 extends in parallel with the locking member 16 (to be described later) of the female housing 1 thereunder, and the second locking pawl 9B projecting from the upper side of the leading end of the downward flexing detecting portion 10 extends forward beyond the leading end of the locking member 16 such that a rear wall 17 of the second locking pawl 9B is situated forward beyond the leading end 16' of the locking member 16. When the locking member 16 is downwardly flexed so as to allow the female and male housings 1, 2 to be coupled together, the leading end 16' of the locking member 16 which is in a downward flexing posture is then situated rearwardly of the locking wall 17 of the second locking pawl 9B as indicated by the dotted line in FIG. 10A, whereby the withdrawal of the detecting spacer 6 is prevented. Thus, the downward flexing detecting portion 10 has a configration meeting configurational requirements for the prevention of withdrawal of the detecting spacer 6.

As shown in FIG. 10(B), the tongue-like lock-releasing portion 12 protruding forward is provided on the rear bottom portion of the mating portion 3 of the male housing 2 in order to release a withdrawal locking means so as to make the detecting spacer 6 free when the female and male housings 1, 2 are properly coupled together, and as shown in FIG. 11(B), this lock-releasing portion 12 has relative position and configuration such that when the female and male housings 1, 2 are in a proper coupled posture, the leading end of the lock-releasing portion 12 comes nearer to and confronts the front dad point locking portion 19A on the female housing 1 side so as to forcibly move upward the first locking pawls 9A of the front dead point locking member 8 which is in mesh with the front dead point locking portion 19A, the engagement between the resilient locking member 8 and the front dead point locking portions 19A being thus released.

In addition, a locking mechanism is provided in the female and male housings 1, 2 which comprises a locking pawl 15 on the male housing 2 side and a resilient cantilever-like locking member 16 on the female housing 1 side, and when the female and male housings 1, 2 are coupled together, the locking pawl 15 downwardly flexes the leading end of the locking member 16, and when the housings are finally coupled, the downwardly flexing of the locking member 16 is released, and the locking member 16 is restored to its free state, whereupon the locking pawl 15 and locking member 16 are brought into mesh engagement with each other, the housings being thereby locked in the coupled posture.

Thus, the detecting spacer 6 and the lock-releasing portion 12 constitute the coupled posture detecting mechanism and the lock confirming mechanism for a coupled posture for the female and male housings 1, 2 respectively.

In the connector described above, when the housings are properly coupled together with the locking member 16 and the locking pawl 15 being put in a proper locked posture, as shown in FIG. 11(B), the leading end of the lock-releasing portion 12 of the male housing 2 forcibly moves upward the first locking pawl 9A which is locked at the front dead point locking portion 19A so as to release the first locking pawl 9A from the locked state, and since the locking member 16 in a proper locked position is then restored to its free posture, there is no interference between the locking member 16 and the second locking pawl 9B, which allows the detecting spacer 6 to be freely withdrawn. When the detecting spacer 6 is pulled out by pinching the knob portion 21, as shown in FIG. 11(C), the third locking pawl 9C of the rear dead point locking member 11 withdraws by a stroke L to a position where the third locking pawl 9C of the rear dead point locking member 19B, and the detecting portion 20 of the detecting spacer 6 appears rearwardly of the female housing 1. Thus, the connector in which the detecting portion 20 is exposed is judged as being a connector which is properly coupled and locked together.

Figure 11D:
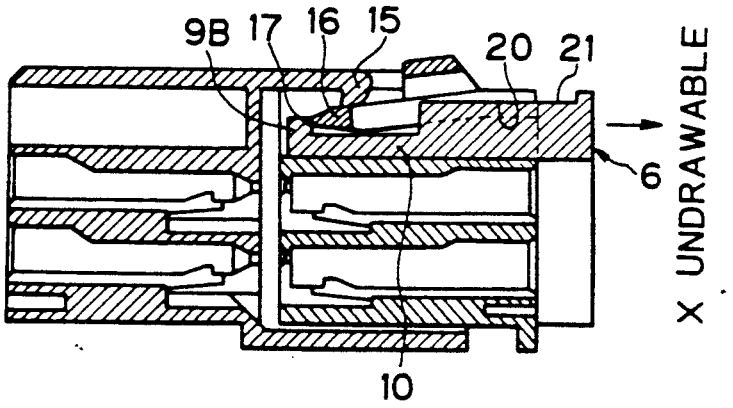
Figure 11E:
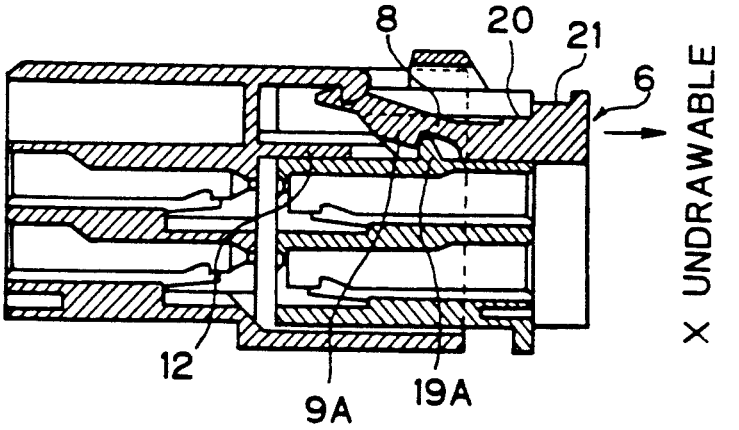

In the case of partial coupling in which a distance by which the female and male housings 1, 2 are coupled together is too short, as shown in FIG. 11(E), the distance in which the lock-releasing portion 12 moves forward is too short, and the front end thereof cannot move upward the first locking pawl 9A of the detecting spacer 6 which is in a locked state to a sufficient extent, which allows the detecting spacer 6 to remain in a locked state with the locking member 16 in a downward flexing posture interfering, as shown in FIG. 11(D), with the locking wall 17 of the second locking pawl 9B, thereby prohibiting the detecting spacer 6 from being withdrawn with the detecting portion 20 being kept hiden. Thus, the connector in which the detecting portion 20 is kept unexposed is judged as being a defective connector having coupling or locking errors.

Moreover, this connector provides a double locking mechanism for the "restriction of withdrawal of the detecting spacer 6" by means of the first and second locking pawls 9A, 9B.

As is described above, in the connector of the above embodiment, since whether or not the detecting portion 20 of the detecting spacer 6 is exposed constitutes a detecting factor, and since the detecting portion 20 is constructed such as to protrude from the rear end of one of the housings, if the size of the detecting portion 20 is set to be appropriate, the aforementioned function in which the visual and feeling detection and confirmation is accurately and easily effected is also enjoyed with the connector of this embodiment.

In the above structure of the connector according to the present invention, the front dead point locking member 8 has to be a resilient member which is flexible upward and downward, and the downward flexing detecting member 10 is not necessarily a resilient member, and although the rear dead point locking member 11 is preferably an independent locking member, the function inherent therein is effected if the third locking pawl 9C exists. Therefore, the relevant function is realized only by providing the third locking pawl 9C projecting sidewardly of the downward flexing detecting member 10, although not shown.

Referring to FIGS. 12 to 16, a fourth embodiment of the connector according to the present invention will be described.

Figure 12:
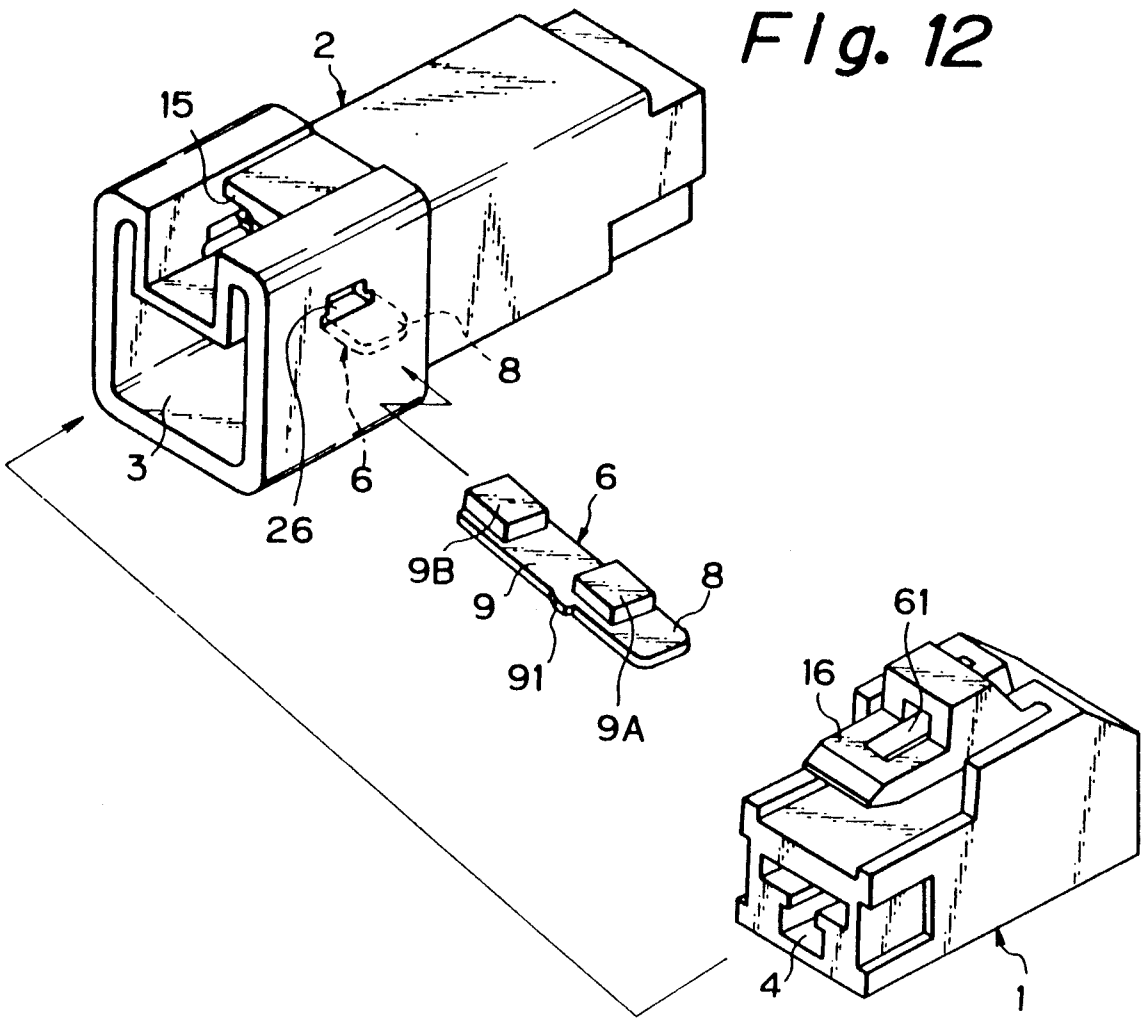
FIG. 12 is an exploded perspective view of a fourth embodiment of the connector according to the present invention.
Figure 13:
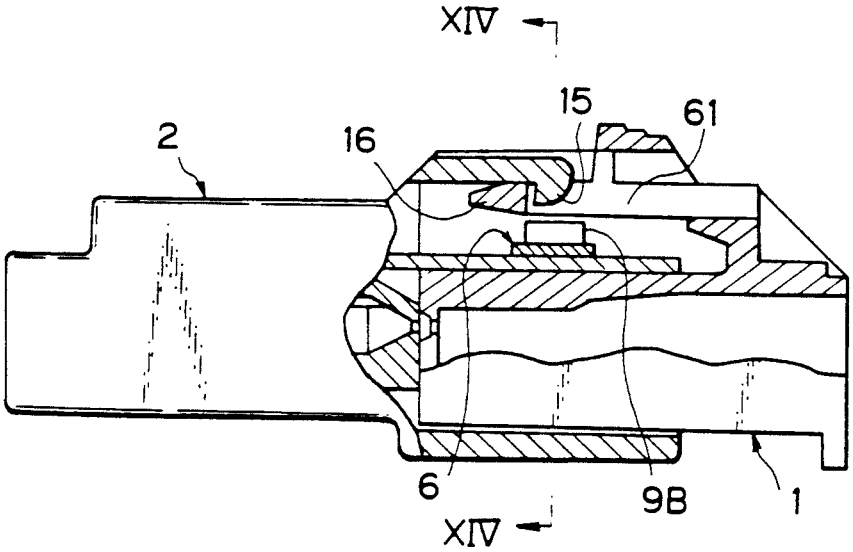
FIG. 13 is a partially cutaway view showing a state in which the connector of FIG. 12 is properly connected together.
Figure 14:
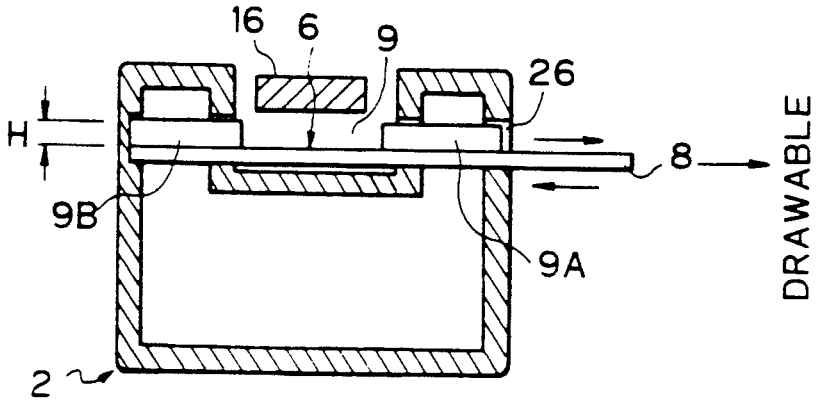
FIG. 14 is a cross-sectional view taken from the line XIV—XIV of FIG. 13.
Figure 15:
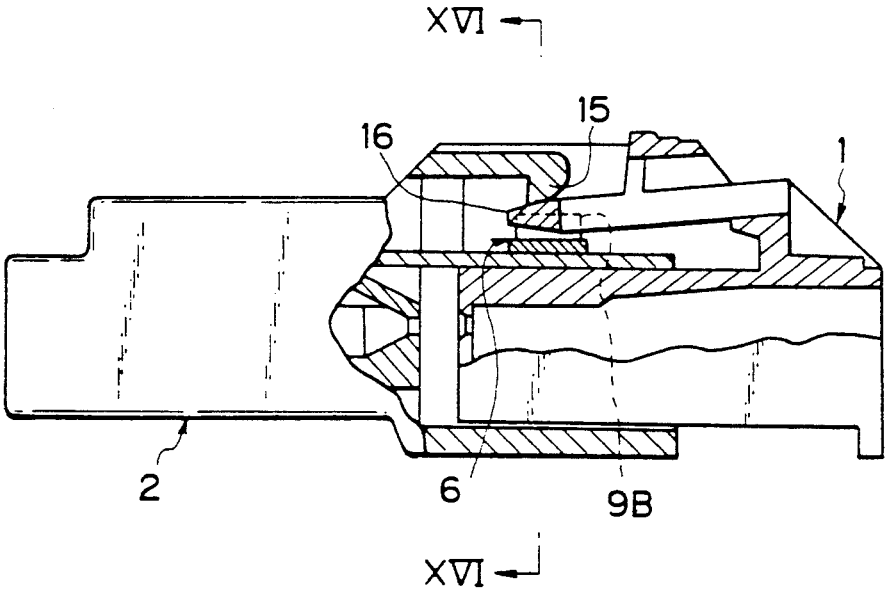
FIG. 15 is a partially cutaway side view showing a state in which the connector of FIG. 12 is abnormally connected together.

As shown in FIGS. 12 to 14, in a connector constructed such that the front half mating portion 3 of the male connector housing (hereinafter simply referred to as the male housing 2) accommodating a male terminal (not shown) and the front half portion of the female connector housing 1 (hereinafter simply referred to as the female housing 1) accommodating a female terminal (not shown) are coupled together for connecting the terminals of the two housings and having a locking mechanism comprising the cantilever-like resilient locking member 16 on the female housing 1 side and the locking portion 15 on the male housing 2 wherein when the female and male housings 1, 2 are coupled together, as shown in FIG. 15, the resilient locking member 16 is brought into interference with the locking portion 15 formed into a downwardly projecting shape and is flexed downwardly so as to pass therethrough to thereby allow the locking portion 15 to fit in a locking hole 61 of the resilient locking member 16 that is released from the downwardly flexed state after a lapse of a predetermined time as shown in FIG. 13, thereby making it possible to lock the female and male connector housings 1, 2 in a coupled posture, as shown in FIGS. 12 and 13, the plate-like detecting spacer 6 is slidably mounted below the locking portion 15 of the male housing 2 in a direction normal to a direction in which the housings are coupled together, and this detecting spacer 6 has a projecting portion 8 whose rear end protrudes from the male housing 2, and which functions as a pinching member of inserting and pulling out the detecting spacer 6.

Figure 16:
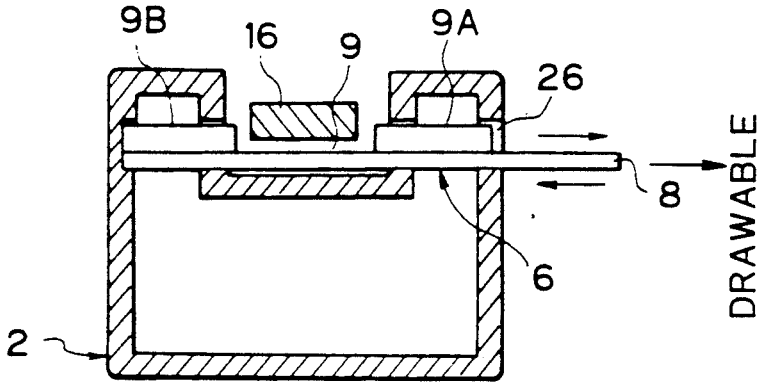
FIG. 16 is a cross-sectional view taken from the line XVI—XVI of FIG. 15.

A downward flexing recessed portion 9 for the resilient locking member 16 is formed at an intermediate position along the detecting spacer 6, in other words, below the locking portion 15 of the detecting spacer 6 that is inserted and secured in a proper posture, and the downward flexing recessed portion 9 is configured such that as shown in FIG. 16, the leading end of the resilient locking member 16 that is flexed downward when the housings are coupled together is received in the downward flexing recessed portion 9.

In addition, interference raised portions 9A, 9B are provided on the sides of this downward flexing recessed portion 9 in the direction in which the detecting spacer 6 is inserted or pulled out in such a manner as to protrude therefrom, and these interference raised portions 9A, 9B are formed into a shape having a height of H which allows the resilient locking member 16 which is in a free posture to pass therethrough as shown in FIG. 14 when the detecting spacer is withdrawn, and which causes the raised portions 9A, 9B to interfere with the resilient locking member 16 that is downwardly flexed as shown in FIG. 16. The detecting spacer 6 has a small locking pawl 91 formed on the side thereof in such a manner as to project therefrom sidewardly, and is provided with a temporary locking means for temporarily locking the detecting spacer 6 in an inserted posture by causing the locking pawl 91 to be caught on the interior wall of the male housing 2. The detecting spacer 6 is easily withdrawn by pinching the projecting portion 8 by the fingers so as to pull it with a slightly strong force. In addition, the detecting spacer 6 is slidably mounted in a spacer hole 26 formed in the circumferential wall of the male housing 2.

In the connector of the above embodiment, as shown in FIGS. 13 and 14, when the female and male housings 1, 2 are properly coupled together with the resilient locking member 16 and the locking portion 15 being brought into engagement with each other, thereby putting the locking member 16 in a free posture, the detecting spacer 6 can be freely withdrawn, and as shown in FIGS. 15 and 16, when the female and male housings 1, 2 are not fully coupled together with the resilient locking member 16 and the locking portion 15 being brought into unproper engagement with each other, putting the resilient locking member 16 in a downword flexing posture, the interference raised portion 9B of the detecting spacer 6 interferes with the resilient locking member 16, whereby the withdrawal of the detecting spacer 6 is prevented, the afore-mentioned function being provided.

In the above structure of the connector according to the present invention, in a case where the withdrawal of the detecting spacer is effected on one of the housings as described above, only the interference raised portion 9B provided on one of the sides suffices therefor, and therefore the interference raised portions 9A, 9B are not necessarily provided on the sides of the downward flexing recessed portion 9. In addition, if the detecting spacer 6 is painted red or the like which is easily recognized, the existence/absence thereof is more easily identified.

As is described above, with the connector of the present invention, since whether the connector is coupled properly or unproperly is confirmed visually or feelingly, the connector is extremely suitable for use as a connector for an automobile or the like in which visual confirmation is difficult, and moreover the connector can also be used as a connector for an apparatus. When used for such applications, the connector of the present invention exhibits an effectiveness in which a coupling error of the connector is prevented in advance, resulting in the improvement of the quality thereof.

With the connector of the present invention, it is possible not only to confirm the conditions in which the connector is coupled and locked by visually and feelingly grasping the existence/absence of the detecting spacer but also to grasp the overall coupling conditions of the connector through the administration of the number of detecting spacers withdrawn. Furthermore, since the connector is provided with the double locking mechanism for the restriction of withdrawal of the detecting spacer, it is possible to obtain high confirming reliability. Thus, the connector of the present invention is extremely suitable for use as a connector for an automobile or the like in which visual confirmation is difficult, and moreover the connector can also be used as a connector for an apparatus. When used for such applications, the connector of the present invention exhibits and effectiveness in which coupling and locking errors of the connector are prevented in advance, resulting in the improvement of the quality thereof.

What is claimed is:

1. A connector comprising:

a pair of connector housings each including a front half portion for accommodating a terminal and which are coupled with each other;

a locking mechanism including a cantilever-like resilient locking member having a leading end and disposed on one of said pair of connector housings, and a locking portion disposed on the other connector housing, in which the leading end of said cantilever-like resilient locking member of the one of said pair of connector housings interferes with said locking portion of the other connector housing so as to be flexed away from a normal state and is then restored to its normal state after a lapse of predetermined time so as to be brought into engagement with said locking portion; and a detecting spacer which is operative to be locked and connected to one of said pair of connector housings by means of another locking member, a lock-releasing portion being provided on the other connector housing for releasing locking between said detecting spacer and said one of said pair of connector housings when said other connector housing is properly coupled with said one of said pair of connector housings, and a second locking portion being provided on said detecting spacer so as to interfere with said cantilever-like resilient locking member of said locking mechanism when said cantilever-like resilient locking member is in a flexed posture which is away from its normal state, to thereby prevent the withdrawal of said detecting spacer when said locking mechanism for said pair of connector housings is in a lock-error condition.

* * * * *